United States Patent [19]

Marelli

[11] Patent Number: 4,916,918

[45] Date of Patent: Apr. 17, 1990

[54] AIR CONDITIONER STAND

[76] Inventor: Douglas A. Marelli, 28 Dewey St., Port Jefferson Station, N.Y. 11776

[21] Appl. No.: 312,210

[22] Filed: Feb. 17, 1989

[51] Int. Cl.[4] ..... F25D 23/12

[52] U.S. Cl. ..... 62/259.1; 62/288; 126/500; 248/678

[58] Field of Search ..... 62/259.1, 285, 288, 62/289; 126/500; 248/676, 678

[56] References Cited

U.S. PATENT DOCUMENTS

| | | | |
|---|---|---|---|
| 3,096,781 | 7/1963 | Roidt | 248/678 X |
| 3,722,845 | 3/1973 | Unger | 248/678 X |
| 3,733,842 | 5/1973 | Numsen | 62/259.1 |
| 3,790,115 | 2/1974 | Fox et al. | 248/678 X |
| 4,118,083 | 10/1978 | Lackey et al. | 62/259.1 X |
| 4,457,140 | 7/1984 | Rastelli | 62/285 X |
| 4,700,687 | 10/1987 | Bailey et al. | 126/500 X |

*Primary Examiner*—William E. Tapolcai
*Attorney, Agent, or Firm*—Richard L. Miller

[57] ABSTRACT

This air conditioner stand is designed to support an air conditioner within the opening of a fireplace instead of a window opening, and the hot air produced by the air conditioner's condenser will be blown up the fireplace chimney by a fan in the circuit of the stand. Primarily, the stand consists of a base that supports the air conditioner, and the base is sloped rearward and is provided with a stop member that includes the mounted fan. Provision is also provided in the stand for water to drain through a flexible hose that may extend into the ash trap opening in the floor of the fireplace.

5 Claims, 1 Drawing Sheet

FIG. 1
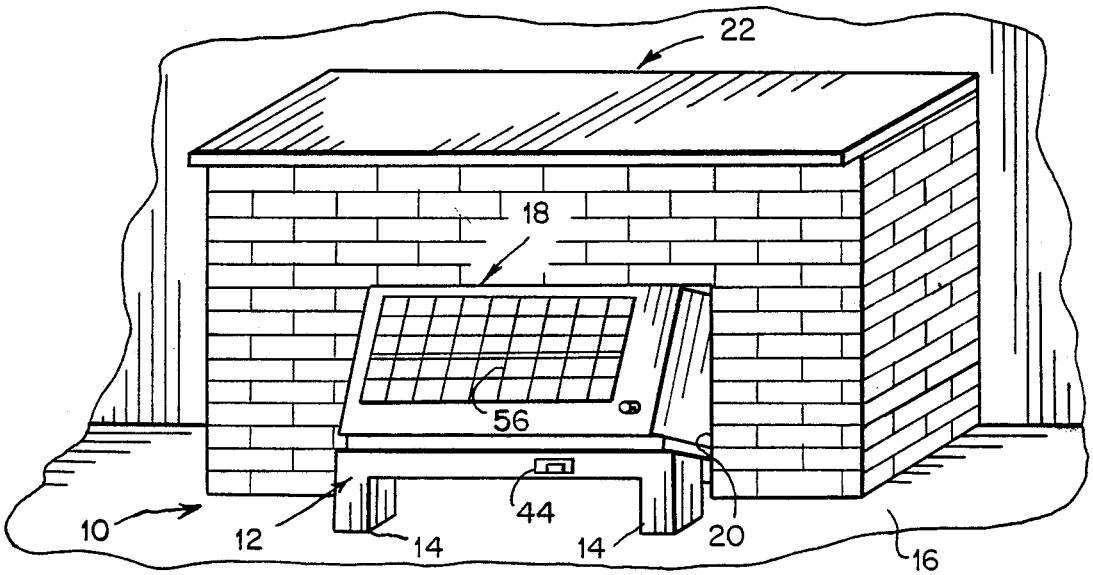
FIG. 2
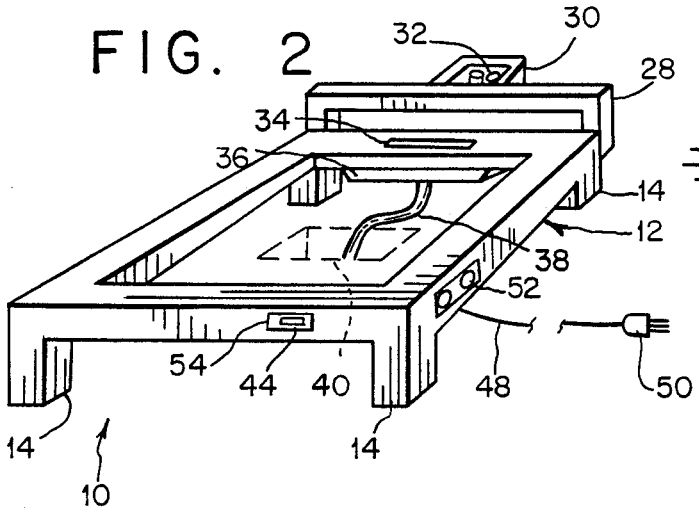
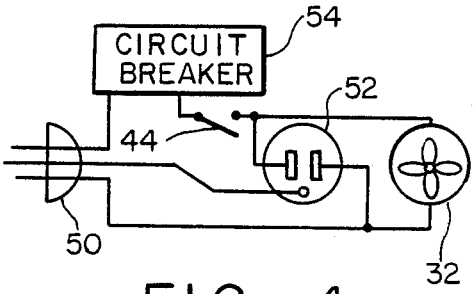
FIG. 4
FIG. 3
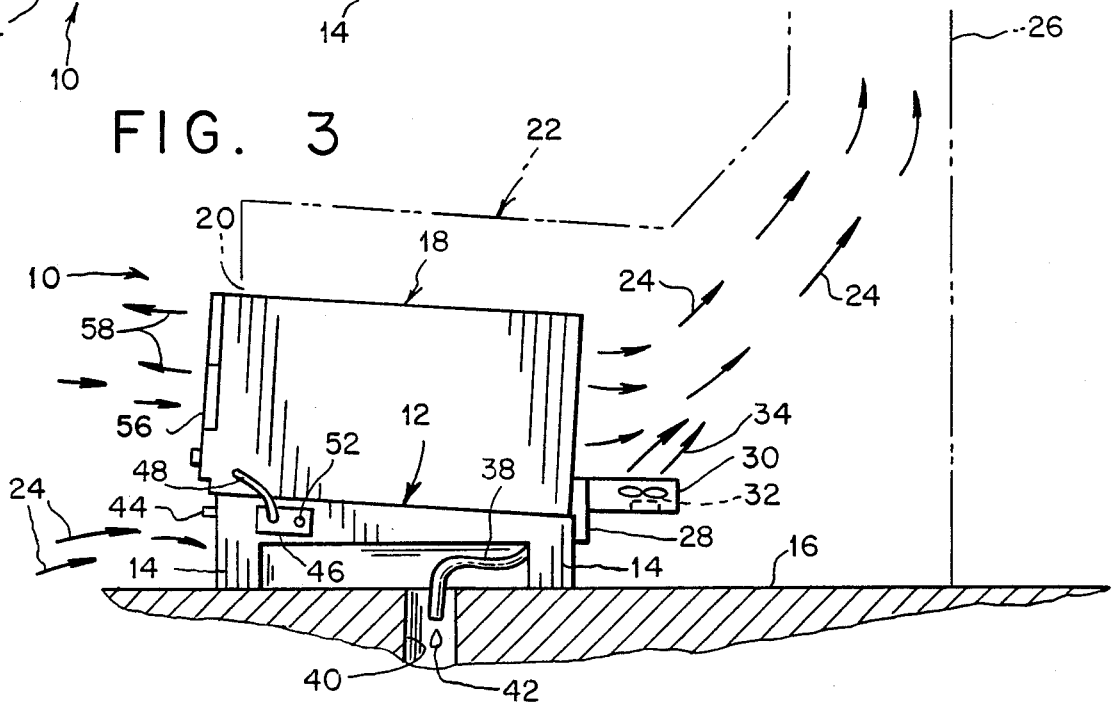

AIR CONDITIONER STAND

BACKGROUND OF THE INVENTION

The instant invention relates generally to air conditioners, and more particularly, to an air conditioner stand.

Numerous support devices have been provided in the prior art that are adapted to support air conditioners. For example, U.S. Pat. Nos. 3,096,781 to Roidt; 3,722,845 to Unger and 3,790,115 to Fox et al all are illustrative of such prior art. While these units may be suitable for the particular purpose to which they address, they would not be as suitable for the purpose of the present invention as hereafter described.

SUMMARY OF THE INVENTION

A primary object of the present invention is to provide an air conditioner stand that will overcome the shortcomings of the prior art devices.

Another object is to provide an air conditioner stand that will be of such design, as to support an air conditioner within a fireplace to feed the hot air produced by the condenser section of the air conditioner, up the chimney.

An additional object is to provide an air conditioner stand that will enable a user to have greater security by the air conditioner not being in an open window for an intruder to take advantage of.

The present invention is especially designed to also prevent heat loss through a window that would normally support the air conditioner and be covered in winter, and after summer use the stand and air conditioner are easily removed for storage.

Further, there will be no more distorted window frames caused by the placement of air conditioners therein, and the air conditioner will not be an unsightly obstruction in a window, which takes away some of the beauty of the user's home.

Also, new home constructions have many custom size windows that cannot hold an air conditioner, and therefore, with the present invention, one will not have to chance damaging brand new windows for the placement of an air conditioner therein.

Many of the homes do not have central air conditioning, and therefore the present invention is safe and convenient for all who have fireplaces.

A further object is to provide an air conditioner stand that is simple and easy to use.

A still further object is to provide an air conditioner stand that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention illustrated installed and ready for use standing in a fire place with an air conditioner resting thereon;

FIG. 2 is a perspective view of the instant invention per se standing alone;

FIG. 3 is a diagrammatic side view illustrating the instant invention in use; and FIG. 4 is an electrical schematic diagram of the instant invention.

DETAILED DESCRIPTION OF THE PREFERRED EMBODIMENTS

Turning now descriptively to the drawings, in which like reference characters denote like elements throughout the several views, a stand 10 is shown to include an open base 12 having legs 14 for supporting base 12 above a floor 16. The top portion of base 12 is sloped rearward and engages with the bottom of an air conditioner 18. The stand 10 and supported fireplace 22, wherein the hot air produced by condenser of the air conditioner 18 will travel upward as indicated by the arrows 24. This hot air produced is aided in upward travel through chimney 26, in a manner which will be described.

A stop member 28 projects upward and is fixedly secured to a rear surface of the base 12 and prevents the air conditioner 18 from sliding rearwards off the stand 10, and a housing 30 is fixedly secured to the rear of the stop member 28 and supports an auxiliary electric fan 32 therein, which blows the hot air produced by the air conditioner rearwards and up the chimney 26.

A condensate water catch opening 34 is provided through the rear portion of the base 12 for air conditioner water to drain into. A pan 36 is secured to the bottom rear of the base 12, and a flexible hose 38 is secured at a bottom opening of the pan 36, for placement in ash trap opening 40 in floor 16, as is typical in most fireplaces, the drain water 42 being received in the ash trap opening 40.

An on-off switch 44 is mounted in the front on the base 12 for control of the fan 32 and the electrical power to the air conditioner 18. An alternating current receptacle 52 is mounted in a side of the base 12 and is connected to an electric cord 48 with a plug 50 that may be received in a suitable electrical outlet receptacle (not shown).

A female plug receptacle 52 is coupled in the circuit of stand 10, which also includes a circuit breaker 54 for over-load protection, as best seen in FIG. 4. Plug receptacle 52 serves for plugging in the air conditioner cord (not shown).

In use, the switch 44 when closed, causes the circuit to the air conditioner 18 and the fan 32 to be closed, and with the air intake vent 56 open the air conditioner 18 will operate, producing cold air indicated by the arrows 58.

Simultaneously, the hot air indicated by the arrows 24, will flow rearward and be blown up the chimney 26 by the fan 32.

When not in use, the air conditioner 18 and fan 32 are shut down by opening the on-off switch 44. When not needing cold air from the air conditioner 18, the base 12 and air conditioner 18 are stored away after removal from the fireplace 22.

While certain novel features of this invention have been shown and described and are pointed out in the annexed claims, it will be understood that various omissions, substitutions and changes in the form and details of the device illustrated and in its operation can be made by those skilled in the art without departing from the spirit of the invention.

What is claimed is:

1. An air conditioner stand, for supporting an operating air conditioner in a fireplace, which comprises:

(a) a base for supporting an air conditioner;

(b) a stop member fixedly secured rearward of said stand;

(c) an auxiliary electric fan mounted at a rear portion of said base;

(d) an electrical circuitry mounted on said base for simultaneously controlling and both said auxiliary electric fan and said air conditioner supported on said base; and (e) means for draining condensate water from said air conditioner into an existing ash trap of said fireplace.

2. An air conditioner stand as set forth in claim 1, wherein legs are fixedly secured to said base and elevate said base from a floor surface within a fireplace opening, and a top surface of said base slopes toward a rear end of said base, and said stop member is fixedly secured to said rear end of said base and engages with a rear end of said air conditioner that is removably received on said top surface of said base.

3. An air conditioner stand as set forth in claim 2, wherein a housing is fixedly secured to said stop member and said auxiliary fan is secured in said housing and blows hot air produced by said air conditioner condenser upward and rearward from said air conditioner up a chimney of said fireplace, and cool air from said air conditioner travels outward of said air conditioner at a front face of said fireplace above a front face of said base.

4. An air conditioner stand as set forth in claim 3, wherein said means for draining condensate water is an opening provided through said rear end of said base which aligns with a water drain pan and said water drain pan is fixedly secured to a bottom surface of said base.

5. An air conditioner stand as set forth in claim 4, wherein said means for draining condensate water further comprises a flexible hose, with a first end of said flexible hose is fixedly secured to a bottom opening in said water drain pan and a second end of said flexible hose entends down into said existing ash trap opening provided in said floor surface within the fireplace opening.

* * * * *